US005361697A

United States Patent [19]

Stellberger

[11] Patent Number: 5,361,697

[45] Date of Patent: Nov. 8, 1994

[54] PLATE CYLINDER OF A ROTARY PRINTING PRESS

[75] Inventor: Rudi Stellberger, Kronau, Germany

[73] Assignee: Heidelberger Druckamschinen AG, Heidelberg, Germany

[21] Appl. No.: 844,131

[22] Filed: Mar. 2, 1992

[30] Foreign Application Priority Data

Mar. 2, 1991 [DE] Germany ..... 4106677

[51] Int. Cl.[5] ..... B41F 13/16

[52] U.S. Cl. ..... 101/415.1; 101/378

[58] Field of Search ..... 101/378, 415.1, DIG. 36, 101/116, 126, 127.1, 128.1

[56] References Cited

U.S. PATENT DOCUMENTS

| | | | |
|---|---|---|---|
| 2,737,887 | 3/1956 | Gericke | 101/415.1 |
| 3,619,217 | 11/1971 | West | 101/465 |
| 4,459,913 | 7/1984 | Kowalik | 101/415.1 |
| 4,643,093 | 2/1987 | Groar et al. | 101/415.1 |
| 4,684,429 | 8/1987 | Dalton, Jr. | 101/401.1 |
| 4,785,736 | 11/1988 | Jeschke | 101/415.1 |
| 4,844,633 | 7/1989 | Greenberg | 101/419 |
| 4,862,800 | 9/1989 | Wieland | 101/415.1 |
| 4,938,135 | 7/1990 | Wieland | 101/378 |
| 4,977,833 | 12/1990 | Inage et al. | 101/415.1 |
| 5,088,409 | 2/1992 | Roskosch | 101/415.1 |

*Primary Examiner*—Ren Yan

*Attorney, Agent, or Firm*—Herbert L. Lerner; Laurence A. Greenberg

[57] ABSTRACT

A plate cylinder of a rotary printing press with a device for adjusting a flexible printing form by a swivelling motion, includes a sleeve adjustable by the adjusting device, the sleeve having an outer cylindrical surface thereon a flexible printing form is mountable.

13 Claims, 3 Drawing Sheets

PLATE CYLINDER OF A ROTARY PRINTING PRESS

The invention relates to a plate cylinder of a rotary printing press, with a device for adjusting i.e., diagonally adjusting, a flexible printing form by a swivelling motion.

A plate cylinder of a rotary printing press of the aforementioned general type has become known heretofore from German Patent 39 18 215. An adjusting device with clamping rails in which there are clamped both ends of a printing plate serving as a printing form is disclosed in the German patent. Swivel levers to which the clamping rails are articulatingly connected at both ends thereof are also described therein. The swivel levers are mounted on the cylinder body, so that the thus mutually connected clamping rails can be swivelled relative to one another about a defined pivot point, through the intermediary of control means, in order to correct the register thereof. The clamping rails are adjusted with respect to one another by means of a bending rod which is deflectable by adjusting means.

Also heretofore known are diagonal adjustment devices of printing plates on plate cylinders wherein, however, adjustment can only be performed while the printing press is stationary. In another heretofore known diagonal adjustment of the printing plate on the plate cylinder, the plate cylinder is, indeed, rotating during the adjustment process, however, the printing plate must not yet have contacted the inking rollers or the rubber-covered cylinder of the printing press. A correction of position after the start of printing is therefore not possible.

Common to all heretofore known plate cylinders provided with diagonal-adjustment devices, however, is that they can De used only for conventional printing plates, i.e. for aluminum plates, for example. The use of the heretofore known plate cylinders is not possible with so-called "high-speed printing forms", because the latter, which are formed, for example, paper or plastic-material foils or sheets, adhere so firmly to the surface of the plate cylinder that a diagonal adjustment is impossible, because the high-speed printing forms would tear due to the forces of adjustment. Such a high-speed printing form may, for example, come directly from a fixing bath just before it is applied to the plate cylinder, which means that the rear side thereof is still damp. This damp rear side then adheres particularly tightly to the outer cylindrical surface of the plate cylinder, so that swivelling for the purpose of aligning the subject of the high-speed printing form is not possible without destroying the substrate. A diagonal adjustment is necessary, however, particularly if the high-speed printing form is fed automatically to the plate cylinder because, during the feeding movement, the paper or plastic-material substrate of the high-speed printing form is cut from a supply reel or the like. Due the transporting movement, a cut surface becomes inclined with respect to the side edges, so that alignment at the front lays prior to the clamping of the high-speed printing form results in the subject being out of register.

Even in the case of conventional printing plates, mostly aluminum plates, however, the diagonal correction of the clamped printing plates poses serious problems. Particularly with regard to large printing presses, such printing plates are clamped on the plate cylinder with very intense forces. Due to these intense forces, the slidability of the printing plate on the cylinder is sharply reduced to an extent that a diagonal or inclined adjustment results in deformations of the printing plate. With respect to printing presses which are equipped with automatic plate feeding, however, it is necessary automatically to correct the plate after a specimen print has been made. It has been known heretofore, for this purpose, completely to release one side of the plate clamping in order to be able to perform such a correction free of any problems. This means, however, that new register errors may occur when the printing plate is re-clamped.

It is accordingly an object of the invention to provide a plate cylinder of a rotary printing press of the aforementioned general type wherein it is possible to adjust clamped printing plates effortlessly on the plate cylinder.

With the foregoing and other objects in view, there is provided, in accordance with the invention, a plate cylinder of a rotary printing press with a device for adjusting a flexible printing form by a swivelling motion, comprising a sleeve adjustable by the adjusting device, the sleeve having an outer cylindrical surface whereon a flexible printing form is mountable.

According to the invention, therefore, the printing form is not directly adjusted diagonally on a conventional outer cylindrical surface of the plate cylinder, but a sleeve is positioned therebetween. This sleeve, which accommodates the printing form on the outer cylindrical surface thereof, is diagonally adjustable in relation to the core of the plate cylinder, so that the printing form, immovably adhering to the outer cylindrical surface of the sleeve or resting thereon, respectively, can be brought into the desired correction position by adjustment of the sleeve. Because there is no relative movement between the printing form and the sleeve, no forces of adjustment are transmitted to the substrate of the printing form. Consequently, it is possible to prevent deformation of the printing plate during the diagonal adjustment. It is also possible to prevent damage as a result of adjustment in the case of paper or plastic-material substrates. Consequently, the plate cylinder according to the invention is also suitable for the application of so-called high-speed printing forms. In particular, diagonal adjustment is possible while the printing press is in operation, and automatic feeding of the printing form to the plate cylinder is permitted.

In accordance with another feature of the invention, the sleeve is formed of a foil, and clamping devices are included on the plate cylinder for clamping the foil.

In accordance with a further feature of the invention, the sleeve is formed as a foil having a mechanical strength sufficient for absorbing adjusting forces exerted by the adjusting device substantially strain-free.

The sleeve, therefore, is formed preferably of a relatively thin, roll-formed or web-shaped material which, however, has sufficient strength to meet the mechanical requirements, so that no impermissible strain/elongation or the like can occur. Attachment thereof to the plate cylinder is preferably effected by means of the aforementioned clamping devices, i.e., the sleeve formed by the foil is replaceable, for example, after it has become worn.

In accordance with an additional feature of the invention, the outer cylindrical surface of the sleeve is formed on material which does not accept printing ink.

In accordance with an added feature of the invention, the plate cylinder has a plate-cylinder core, and the sleeve is formed with an inner surface at which it is of a material having low friction with respect to a surface of the plate-cylinder core.

The non-acceptance of ink or oleophobic characteristic of the sleeve material prevents the outer cylindrical surface of the sleeve from becoming inked through the acceptance of printing ink. To permit diagonal adjustment to be performed with relatively low adjustment forces, the inner surface of the sleeve or foil, as aforementioned, is on a material which has a high level of slidability, i.e., low friction, with respect to the surface of the plate-cylinder core. Through a suitable selection of material at the surface of the plate-cylinder core and of the material at the inner surface of the sleeve, it is possible to obtain a desired, defined frictional value. Because the printing form is applied to the outer cylindrical surface of the sleeve and, if necessary or desirable is immovably held there, the material of the printing plate thus has no influence on the frictional forces which must be overcome in the course of the diagonal adjustment. Rather, the aforementioned selection of material ensures that one will always be able to assume that a constant frictional value or coefficient of friction exists.

In accordance with yet another feature of the invention, the surface of the plate-cylinder core has a texture formed with convex structural elements. These microscopically small, convex elevations or raised projections formed by the texturizing structural elements ensure a reduction in the size of the contact area between the jacket-forming sleeve and the plate-cylinder core. To this extent, even small forces of adjustment are sufficient for the desired diagonal adjustment.

In accordance with yet a further feature of the invention, the sleeve is formed as a foil, the foil being a laminate foil formed of a plurality of layers, including at least an outer layer and an inner layer. The outer layer is of such material that there is no fear of ink acceptance. The inner layer is selected with a view to providing as low a frictional value or coefficient of friction as possible. Both layers, or at least one of them, must have sufficient mechanical strength to permit the adjustment to be performed without damage and to ensure that there is no strain/elongation or the like, which might result in distortion or deformation of the subject of the printing form. In accordance with yet an added feature of the invention, the outer layer is formed of steel. More specifically, in accordance with the invention, the steel is stainless steel. Such material is oleophobic and offers no acceptance to the printing ink.

In accordance with yet an additional feature of the invention, the inner layer is formed of synthetic material.

More specifically, in accordance with the invention, the synthetic material is polytetrafluoroethylene. Thus, materials known by the trade names Teflon and PEEK are suitable.

In accordance with still another feature of the invention, there are provided means defining a cylinder gap having a leading-edge printing zone and a trailing-edge printing zone, a first strip-shaped holding element disposed in the gap of the plate cylinder in the leading-edge printing zone thereof, and a second strip-shaped holding element disposed in the gap in the trailing-edge printing zone thereof, for fastening the sleeve.

More specifically, in accordance with the invention, the holding elements are adjustable by the adjusting device. The desired diagonal adjustment of the printing form is thereby afforded.

In accordance with still a further feature of the invention, the holding elements comprise clamping elements for clamping the sleeve.

In order to hold the printing form, in accordance with still an added feature of the invention, there are provided clamping means for the printing form disposed on at least one of the holding elements.

In accordance with still an additional feature of the invention, the adjusting device comprises at least one eccentric lever, the holding elements being mounted on the eccentric lever. By adjusting the eccentric lever, the holding elements may be moved and, thereby, the diagonal adjustment may be performed.

In accordance with another feature of the invention, the eccentric lever is disposed on one of a drive side and an operator side of the plate cylinder, and the holding elements are mounted on bearing levers, and actuating rods are included connecting the eccentric lever to the bearing levers for the holding elements, the bearing levers being disposed on the other of the drive side and the operator side. The two holding elements can, therefore, be adjusted, respectively, by the eccentric lever and by the bearing levers which are movable by the eccentric lever through the intermediary of the actuating rods. The lever ratios of the eccentric lever and the bearing levers are selected so that there is a precise, proportional swivelling movement of the holding elements and the sleeve therewith and therefore of the printing form.

In accordance with a further feature of the invention, there are provided spring means for preloading at least one of the holding elements in circumferential direction of the plate cylinder.

Also, in accordance with an alternative feature of the invention, there are provided spring means for preloading at least one of the clamping elements in circumferential direction of the plate cylinder. This has the advantage that the sleeve is always tautly held, even if, due to a diagonal adjustment, a slight change in the circumferential length occurs. Such a change in length is then compensated for by the spring means or spring elements, i.e., the sleeve is continued to be held under tension thereby.

In accordance with a concomitant feature of the invention, there is provided an adjusting element mounted on an axial thread, the adjusting element being axially adjustable in position thereof on the plate cylinder, an axial tension/compression element connecting the adjusting element to the eccentric lever for swivelling the eccentric lever in accordance with the axial adjustment of the adjusting element. If the adjusting element is turned or swiveled in relation to the plate cylinder, an axial displacement occurs through which the tension/compression element transmits appropriate adjusting forces to the eccentric lever. The eccentric lever swivels and, is doing so, moves the actuating rods thereof, which swivel the bearing levers associated therewith. The eccentric lever and the bearing levers move the holding elements for the sleeve, so that the desired diagonal adjustment of the jacket-forming sleeve for aligning the printing form occurs.

Other features which are considered as characteristic for the invention are set forth in the appended claims.

Although the invention is illustrated and described herein as embodied in a plate cylinder of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
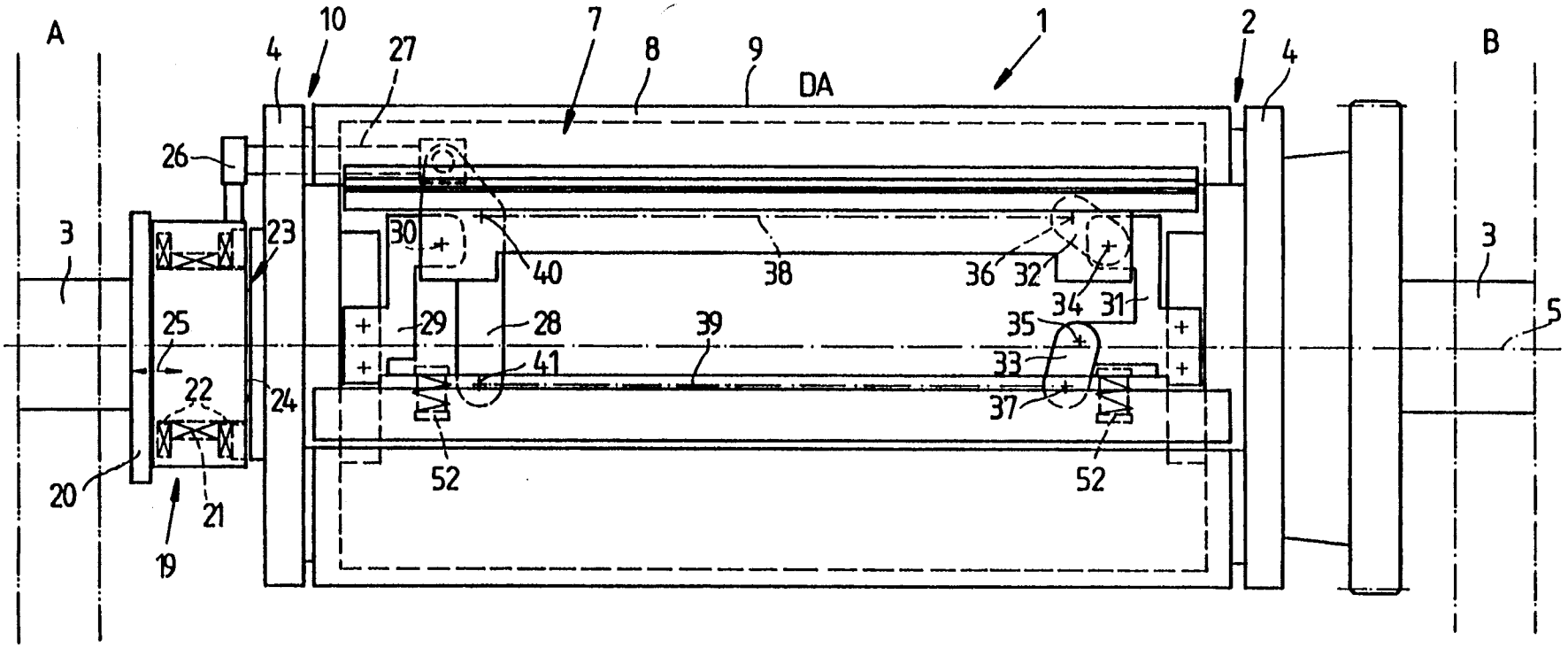
FIG. 1 is a longitudinal view of a plate cylinder with a device for diagonally adjusting a printing form.

Referring now to the drawing and, first, particularly to FIG. 1 thereof, there is shown therein a plate cylinder 1 of an otherwise non-illustrated rotary printing press, particularly an offset printing press. The plate cylinder 1 is formed of a cylinder body 2 with two journals 3. One of the journals 3 is on a drive side A of the printing press; the other journal 3 is on an operator side B of the press. Cylinder bearers or Schmitz rings 4 are provided at both ends of the cylinder body 2. The cylinder body 2, the journals 3 and the cylinder bearers 4 are disposed rotationally or axially symmetrically to a rotational axis 5 of the plate cylinder 1.

Figure 2:
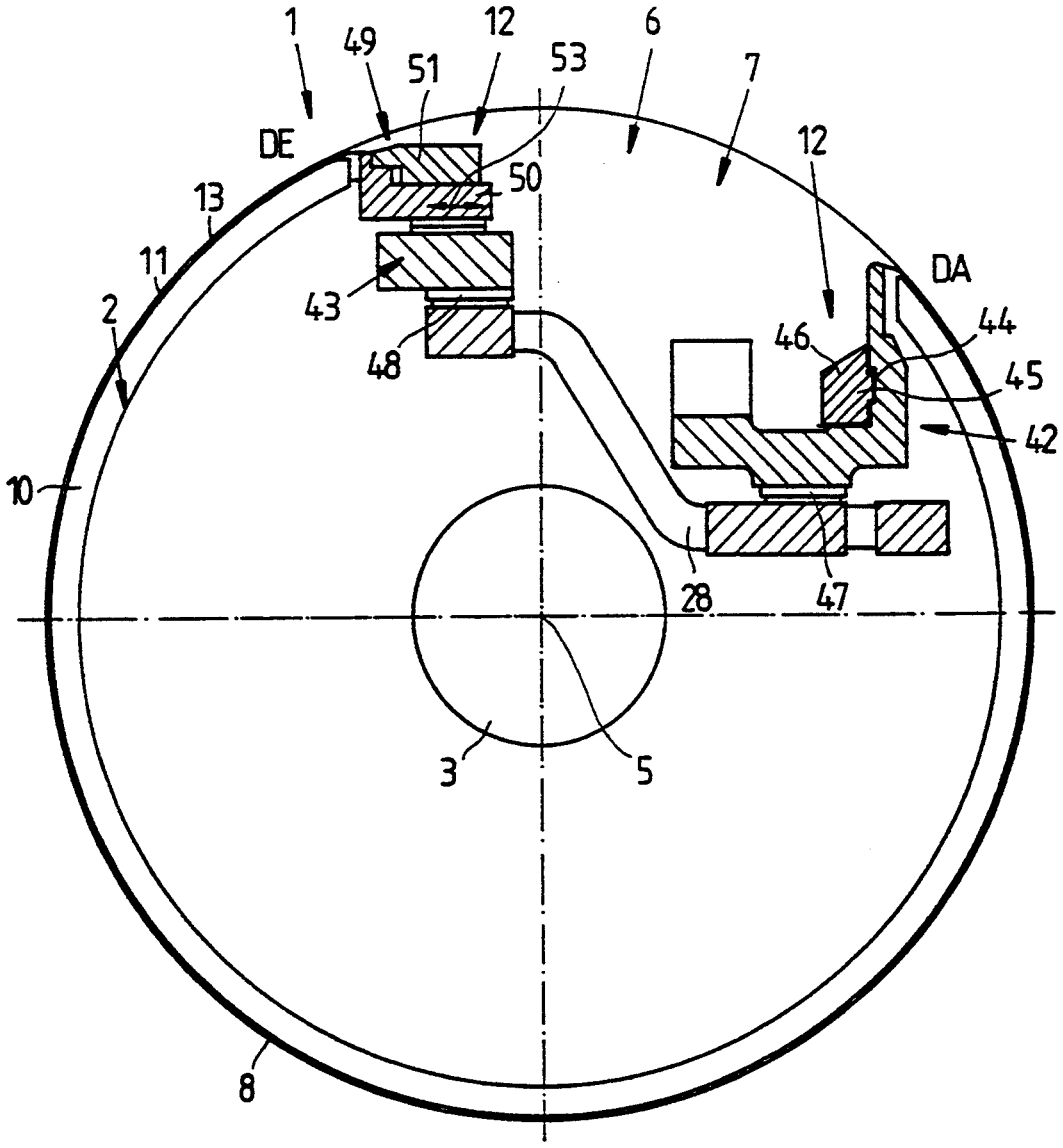
FIG. 2 is an enlarged end view partly in cross section of the plate cylinder of FIG. 1.

It is clearly apparent from FIG. 2 that the plate cylinder 1 is formed with a recess or gap 6, which extends over the entire width thereof. This gap 6 accommodates a device 7 therein for adjusting a flexible printing form 60. A more detailed description is provided hereinafter. In accordance with the direction of rotation of the plate cylinder 1, one side region of the gap 6 is designated a leading-edge printing zone DA and the other side region of the recess 6 is designated a trailing-edge printing zone DE. A support 8 for the printing form is disposed on the cylinder body 2 and, except for the region of the gap 6, surrounds the entire cylinder body 2. In this regard, the printing-form support 8 represents a type of jacket. The actual surface of the plate cylinder 2 is formed by the outer cylindrical surface 9 of the support 8. In this regard, the cylinder body 2 merely represents a plate-cylinder core 10.

Figure 3:
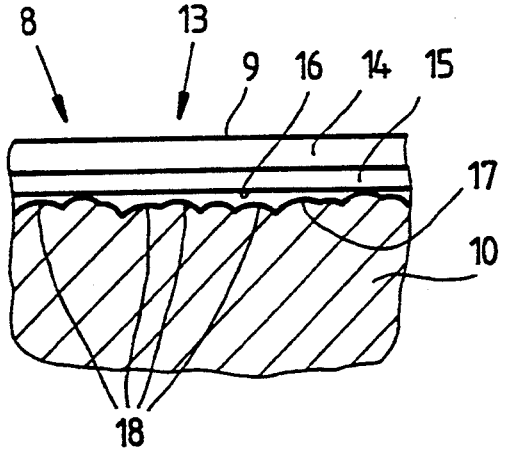
FIG. 3 is an enlarged fragmentary sectional view of FIG. 1 showing a detail of the plate-cylinder core of the plate cylinder having a jacket disposed thereon and forming a sleeve.

It is clear from FIG. 2 that the sleeve 8 is formed of a relatively thin, flexible foil 11, which is held by clamping devices 12. The clamping devices 12 are disposed within the cylinder gap 6. The foil 11 is preferably formed as a laminate foil 13, i.e., it is made up of a plurality of layers. FIG. 3 shows a laminate foil 13 formed of a first layer 14 and a second layer 15. The first layer 14, which forms the outer cylindrical surface 9 of the sleeve 8, is made up of a material which does not accept printing ink, i.e., is oleophobic. Preferably, the material is steel, particularly stainless steel. The second layer 15 is applied to this stainless-steel foil (first layer 14). The second layer 15 is a coating of plastic material, preferably tetrafluoroethylene such as is known by the trade names Teflon or PEEK. The inner surface 16 of the sleeve 8 is thus a surface of great slidability. It is further apparent from FIG. 3 that the plate-cylinder core 10 has a surface texture 17 with convex structural elements 18 and, consequently, upon relative movement between the sleeve 8 and the plate-cylinder core 10, to be described hereinafter in greater detail, a low coefficient of friction having a precisely defined magnitude appears.

FIG. 1 shows an adjusting element 19 disposed on the drive side A between the journal 3 and the appertaining cylinder bearer 4. The adjusting element 19 is provided with a shifting gearwheel 20. Further provided in the region of the adjusting element 19 are a radial bearing 21 and an axial bearing 22. The adjusting element 19 is formed with an internal thread by which it is screwed onto an external thread 23 of a shaft section 24 of the plate cylinder 1. In the installed condition thereof in a printing press, the shifting gearwheel 20 of the plate cylinder 1 meshes with a corresponding adjustable gearwheel whereby, due to a relative movement with respect to the cylinder body 2, an axial displacement of the adjusting element 19 is effected. Depending upon the direction of this relative movement, therefore, the adjusting element 19 can be moved axially in one of the directions represented by the double-headed arrow 25. This displacement is caused by the external thread 23, on which the adjusting element 19 is mounted. Upon the occurrence of an axial movement of the adjusting element 19, an eccentric lever 28, which is disposed in the cylinder gap 6, is swivelled by a bearing lever 26, which is part of a tension/compression element 27. Assigned to the cylinder body 2 of the plate cylinder 1 is a locally fixed bearing element 29 on which the eccentric lever 28 is supported on a pivot point 30.

On the operator side B of the plate cylinder 1, a further bearing element 31 is disposed within the cylinder gap 6 in a locally fixed manner with respect to the cylinder body 2. Two bearing levers 32 and 33 are supported on respective pivot points 34 and 35 on the bearing element 31 in a spaced-apart relationship. The bearing levers 32 and 33 have swivel points 36 and 37, which are connected via bearing points 40 and 41 to the eccentric lever 28 through the intermediary of actuating rods (indicated only in the form of phantom lines 38 and 39, respectively).

It can be seen from FIGS. 1 and 2 that the beginning or leading edge and the end or trailing edge of the support 8, formed by the foil 11, are held in strip-shaped holding elements 42 and 43 of the clamping devices 12. For this purpose, the holding element 42 is formed with an elongated recess 44 in which a strip-shaped projection 45 of a clamping element 46 engages. The foil 11 extends between the clamping element 46 and the holding element 42, both of the latter elements 42 and 46 being clampable together, with the result that the foil 11 is able to be firmly pressed into the elongated recess 44 by means of the projection 45 and is consequently able to be firmly held thereby. The eccentric lever 28 is connected to the holding element 42 through the intermediary of a rotary connection 47.

The holding element 43 is supported on the eccentric lever 28 through the intermediary of a rotary connection 48. The eccentric lever 28 carries a clamping element 49, which is formed by a rail 50 and a strip-shaped clamping member 51. Through the intermediary of spring elements 52 (FIG. 1), the clamping element 49 is braced against the holding element 43 so that, under the pressure of the spring elements 52, it is able to perform a compensating movement in the circumferential direction (double-headed arrow 53). In the region of the end or trailing edge printing zone DE, the corresponding end or trailing-edge region of the foil 11 is clamped between the clamping member 51 and the rail 50.

The two holding elements 42 and 43 are supported on the bearing lever 32 and 33 in the region of the operator side B of the plate cylinder 1.

The plate cylinder 1 according to the invention operates as follows: When a printing form is fed, preferably automatically, to the plate cylinder 1, the beginning or leading-edge of the printing form is clamped at the holding element 42 in the region of the beginning or leading-edge printing zone DA by clamping means 61. The underside of the printing form rests on the outer cylindrical surface 9 of the support 8. The end or trailing-edge region of the printing form is likewise held by clamping means of the clamping element 49. In the case of small printing presses which employ high-speed printing forms in which the corresponding printed subject is on a paper or plastic-material substrate, it is also possible to proceed in a manner wherein only the beginning or leading-edge of the high-speed printing form is clamped, and the end or trailing edge of the high-speed printing form is not clamped. The high-speed printing form adheres so firmly to the outer cylindrical surface 9 of the support 8 that it is possible to rule out any relative displacement between these parts. Such adhesion is particularly pronounced whenever the high-speed printing form, for example, is coming directly from a fixing bath, i.e., when it remains damp yet on the rear side thereof. Because the high-speed printing form is fed preferably automatically and is also cut from a supply reel while it is in motion, the cut-off edge may not be correctly aligned angularly with respect to the subject of the high-speed printing form. A consequence thereof is that, due to the diagonally extending cut-off edge, which runs up against stop means of the holding element 42 and is then held there by the non-illustrated clamping means, the subject of the high-speed printing form is not correctly aligned angularly for the operation of the printing form. This alignment may be performed by the aforedescribed device 7.

In the case of large sheet-fed presses, although automatic plate feeding is considerably more precise therein than in the case of small printing presses, a correction is nevertheless likewise necessary due to the higher quality demands made upon the printed product. This applies as well to manually inserted plates which should be corrected. For this purpose, the shifting gearwheel 20 may be driven relative to the cylinder body 2 by means of the non-illustrated adjustable gearwheel either during printing, i.e., during the rotation of the plate cylinder 1, or also while the latter is stationary. The adjusting element 19 is displaced axially with the shifting gearwheel 20, the displacement motion being transmitted via the bearing lever 26 and the further tension/-compression elements 27 to the eccentric lever 28, so that the latter is swivelled accordingly. This swivelling motion is transmitted via the actuating rods (the phantom lines 38 and 39) to the respective bearing levers 32, 33. The holding elements 42 and 43 are swivelled in a corresponding manner by the swivelling of the eccentric lever 28 and the bearing levers 32 and 33, the overall result of which is a diagonal or inclined adjustment, i.e., the sleeve 8 is swivelled on the surface of the plate-cylinder core 10, thereby entraining the firmly adhering non-illustrated high-speed printing form and bringing it into a position in which the subject is correctly aligned for printing. This diagonal-adjustment process may cause a change in the circumferential length of the support 8, which, however, is compensated for by means of the spring element 52.

The specific construction of the holding and adjustment means as a support and a plate is merely one example; further constructions are conceivable within the scope of the invention.

We claim:

1. In combination, a flexible printing form and a plate cylinder of a rotary printing press having a cylinder body and provided with a device for adjusting the flexible printing form by a swivelling motion, comprising a support for the flexible printing form in the form of a foil disposed on the cylinder body and being adjustably movable relative thereto by the adjusting device, said printing-form support having an outer cylindrical surface whereon the flexible printing form is mounted, means defining a cylinder-gap having a leading-edge printing zone and a trailing-edge printing zone, a first strip-shaped holding element disposed in said gap of the plate cylinder in said leading-edge printing zone thereof, and a second strip-shaped holding element disposed in said gap in said trailing-edge printing zone thereof, for fastening said printing-form support, and clamping means for the printing form disposed on at least one of said holding elements, and including clamping devices on the plate cylinder for clamping said foil, wherein said outer cylindrical surface of said printing-form support is formed of material which does not accept printing ink, and wherein the plate cylinder has a plate-cylinder core, and said printing-form support is formed with an inner surface which is of a material having low friction with respect to the surface of said plate-cylinder core.

2. Plate cylinder according to claim 1, wherein said surface of said plate-cylinder core has a texture formed with convex structural elements.

3. Plate cylinder according to claim 1, wherein said foil includes an outer layer and an inner layer, said outer layer being formed of steel and said inner layer being formed of synthetic material.

4. Plate cylinder according to claim 3, wherein the steel is stainless steel.

5. Plate cylinder according to claim 3, wherein said synthetic material is polytetrafluoroethylene.

6. Plate cylinder according to claim 1, wherein said holding elements are adjustable by said adjusting device.

7. Plate cylinder according to claim 1, wherein said holding elements comprise clamping elements for clamping said printing-form support.

8. Plate cylinder according to claim 7, including spring means for preloading at least one of said clamping elements in circumferential direction of the plate cylinder.

9. Plate cylinder according to claim 1, wherein the adjusting device comprises at least one eccentric lever, said holding elements being mounted on said eccentric lever.

10. Plate cylinder according to claim 9, wherein said eccentric lever is disposed on one of a drive side and an operator side of the plate cylinder and including bearing levers disposed on the other of said drive side and said operator side, said holding elements being mounted on said bearing levers, and actuating rods connecting said eccentric lever to said bearing levers for said holding elements.

11. Plate cylinder according to claim 1, including spring means for preloading at least one of said holding elements in circumferential direction of the plate cylinder.

12. In combination, a flexible printing form and a plate cylinder of a rotary printing press having a cylinder body and provided with a device for adjusting the flexible printing form by a swivelling motion, comprising a support for the flexible printing form disposed on the cylinder body and being adjustably movable relative thereto by the adjusting device, said printing-form support having an outer cylindrical surface whereon the flexible printing form is mounted, means defining a cylinder gap having a leading-edge printing zone and a trailing-edge printing zone, a first strip-shaped holding element disposed in said gap of the plate cylinder in said leading-edge printing zone thereof, and a second strip-shaped holding element disposed in said gap in said trailing-edge printing zone thereof, for fastening said printing-form support, said adjusting device comprising at least one eccentric lever, said holding elements being mounted on said eccentric lever, including a cylinder shaft formed with an axial thread, an adjusting element mounted on said axial thread, said adjusting element being axially adjustable in position thereof on the plate cylinder, an axial tension/compression element connecting said adjusting element to said eccentric lever for swivelling said eccentric lever in accordance with the axial adjustment of said adjusting element.

13. A plate cylinder including clamping devices for supporting a flexible printing form in a rotary printing press and a device for adjusting the flexible printing form by swivelling motion of the clamping devices for the printing form, the plate cylinder having a cylinder body and a cylinder core with a surface, and a support for the flexible printing form in the form of a foil disposed on the cylinder body and being adjustably movable relative thereto by the adjusting device, said support having an outer cylindrical surface wherein the flexible printing form is mountable;

said clamping devices being disposed on the plate cylinder for clamping said foil;

said outer cylindrical surface of said foil being formed of material which does not accept printing ink; and said foil being formed with an inner surface of a material having low friction with respect to the surface of said plate-cylinder core.

* * * * *